United States Patent [19]

Filippi et al.

[11] Patent Number: 4,651,779

[45] Date of Patent: Mar. 24, 1987

[54] CONSTANT-PRESSURE DELIVERY VALVE FOR FUEL INJECTION PUMPS FOR DIESEL ENGINES

[75] Inventors: Renato Filippi, Nichelino; Angelo Beatrice, Bari, both of Italy

[73] Assignee: Weber S.p.A. Azienda Altecna, Turin, Italy

[21] Appl. No.: 884,248

[22] Filed: Jul. 10, 1986

[30] Foreign Application Priority Data

Oct. 22, 1985 [IT] Italy ..... 53965/85[U]

[51] Int. Cl.[4] ..... F02M 59/46

[52] U.S. Cl. ..... 137/493.3; 123/506; 417/296; 417/501

[58] Field of Search ..... 123/506; 137/493.3, 137/493.4, 512.2; 417/296, 501

[56] References Cited

U.S. PATENT DOCUMENTS 1,999,967 4/1935 Miller ..... 137/493.3
3,195,465 7/1965 Hug ..... 417/296
3,479,999 11/1969 Keller ..... 137/512.2
4,459,086 7/1984 Hafele ..... 417/296
4,467,767 8/1984 Kampichler ..... 123/506 X

FOREIGN PATENT DOCUMENTS 2107000 4/1983 United Kingdom ..... 123/506

*Primary Examiner*—Robert G. Nilson
*Attorney, Agent, or Firm*—Sughrue, Mion, Zinn, Macpeak & Seas

[57] ABSTRACT

A constant-pressure delivery valve for fuel injection pumps for diesel engines includes a conical-surface obturator to which is fixed a body forming an axial chamber containing a calibrated one-way valve with a ball obturator. The ball obturator is located on that side of the chamber facing the conical-surface obturator and controls communication between radial and axial fuel return passages formed beneath the bottom of the chamber.

4 Claims, 4 Drawing Figures

CONSTANT-PRESSURE DELIVERY VALVE FOR FUEL INJECTION PUMPS FOR DIESEL ENGINES

Figure 1:
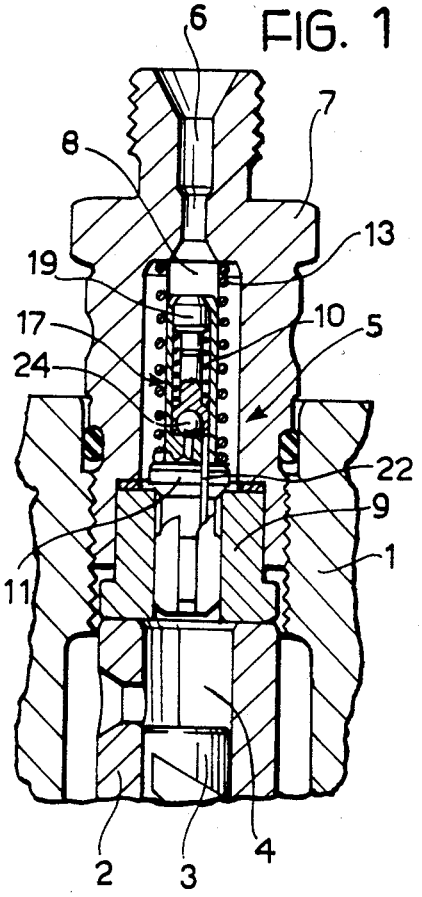

The present invention relates to delivery valves for fuel injection pumps for diesel engines, of the type including a tubular valve body fixed to the outlet of the pressure chamber of an injection pump and defining an annular valve seat which cooperates with an obturator having a conical surface and urged into a closed position by a biassing spring, and in which the conical-surface obturator is fixed to a body forming an axial chamber containing a calibrated one-way valve with a ball obturator biassed by a helical spring and controlling the communication between fuel return passages formed in the body, which communicate with the chamber and open respectively upstream and downstream of the conical-surface obturator.

A valve of this type is known, for example, from European Patent Application No. 143296, in which the ball obturator of the one-way valve is located on that side of the chamber of the body opposite the conical-surface obturator and the seat for the ball obturator is carried by an insert driven into this part of the chamber of the body, and in which the fuel return passages opening upstream and downstream of the conical-surface obturator are constituted by two opposing holes coaxial with the chamber and formed in the body and through the insert, respectively.

With this solution, there may arise the disadvantage that the ball obturator continuously knocks against its seat in the insert, causing the insert to become disengaged from the body in time. Moreover, this solution may involve problems in the assembly of the valve, particularly with regard to the achievement and maintenance of the necessary seal between the insert and the body.

A further disadvantage of this solution lies in the fact that the fitting of the one-way valve into the cavity in the body is relatively complicated, particularly with regard to the calibration of the biassing spring acting on the ball obturator.

A solution is also known from European Patent Application No. 73967, in which the seat for the ball obturator is formed directly in the body of the valve instead of in a separate insert. However, this solution, the arrangement of which is similar to that considered above, may have the disadvantage that, should any component of the one-way valve break, such as, for example, the biassing spring for the ball obturator, fragments may penetrate the pressure chamber of the pump with consequent risks.

The object of the present invention is to avoid these disadvantages, and this object is achieved by virtue of the fact that the chamber in the body has a bottom wall located at the end with the conical-surface obturator and spaced therefrom, in that the ball obturator of the one-way valve is located at the end of the chamber with the bottom wall, and in that the return passages include at least one radial hole formed in the body between the conical-surface obturator and the bottom of the chamber and communicating with the latter through a central axial passage the inner end of which forms a valve seat for the ball obturator, and one or more lateral axial passages offset relative to the central axial passage and the radial passage and putting the bottom of the chamber of the body into communication with the pressure chamber of the pump.

By virtue of this characteristic, the risk of any fragments of the components of the one-way valve reaching the pressure chamber of the pump in the event of breakage in considerably reduced.

According to the invention, the ball obturator is carried by a support against which reacts one end of the helical biassing spring whose opposite end reacts against a closure part for the chamber.

This closure part may be constituted by an integral transverse wall of the body or by a stopper fixed to the body in an axial position which can be varied in dependence on the calibration of the spring and the opening travel of the ball obturator.

The stopper may be driven into the body or connected thereto by a threaded coupling with the possible addition of a locking glue. This latter solution enables the assembly of the valve to be simplified considerably, rendering the calibration of the biassing spring easier.

Furthermore, the correct dimensioning of the fuel inlet and outlet holes through the ball obturator and the limiting of the travel of this ball obturator enable excessive detachment of the ball obturator to be avoided at the moment the conical-surface obturator hits its seat.

Figure 2:
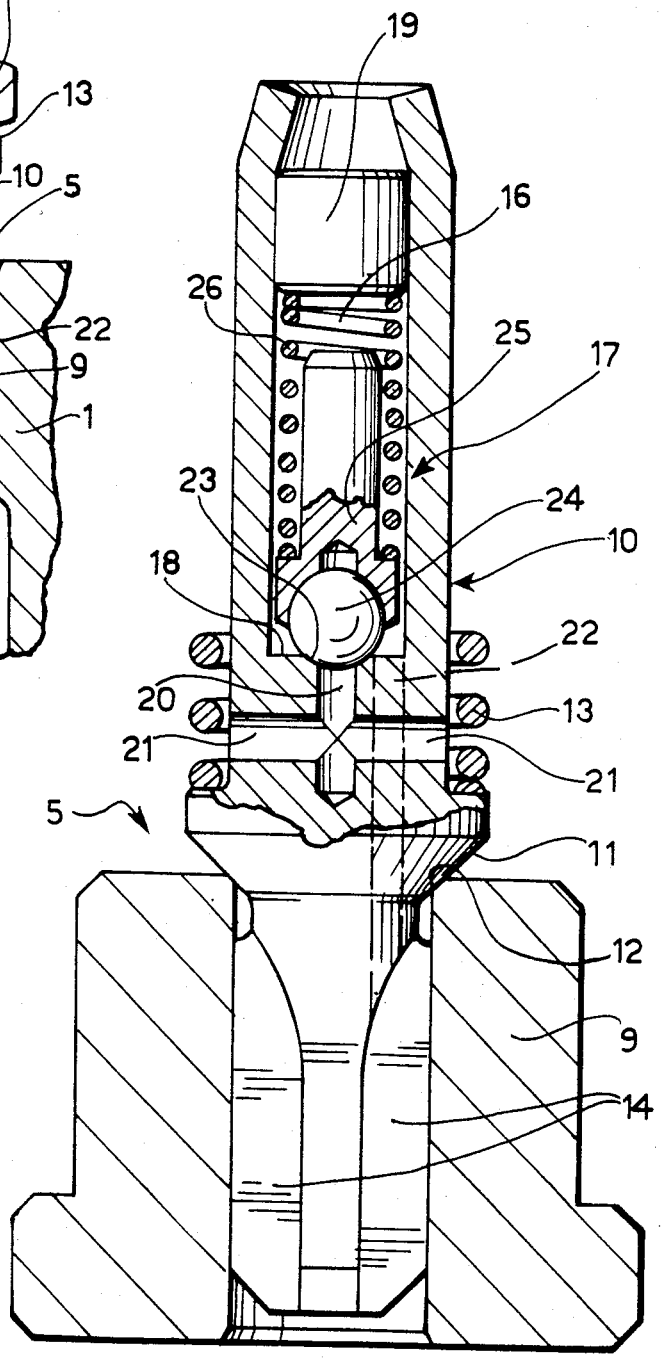
Figure 4:
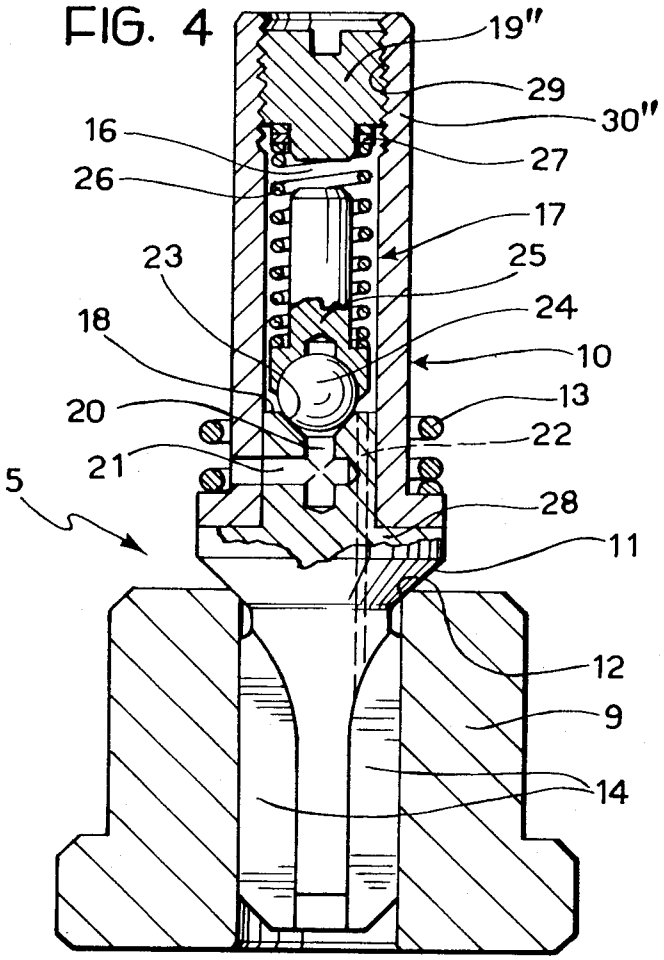
Figure 3:
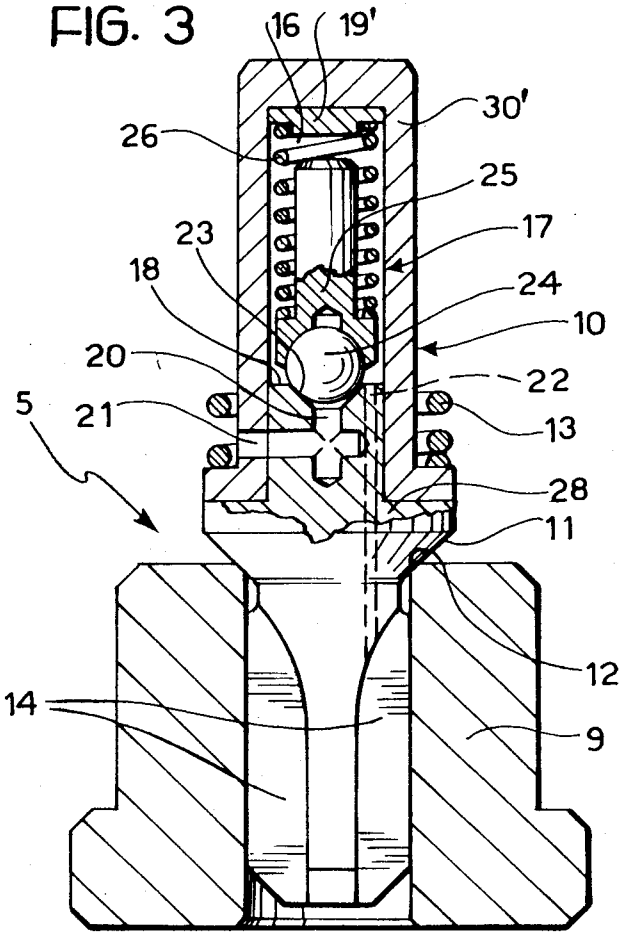

Further characteristics and advantages of the invention will become apparent from the detailed description which follows with reference to the appended drawings provided purely by way of non-limiting example, in which:

FIG. 1 is a schematic axial sectional view of part of a fuel injection pump for a diesel engine provided with a constant-pressure delivery valve according to the invention, FIG. 2 shows a detail of FIG. 1 on an enlarged scale, and FIGS. 3 and 4 illustrate two variants of FIG. 2.

In FIG. 1, the body of an in-line fuel injection pump for a diesel engine is generally indicated 1 and includes a cylinder 2 in which a pump piston 3 is sealingly slidable in the manner well known to experts in the art. The upper part of the cylinder 2 defines a pressure chamber 4 communicating through a delivery valve, generally indicated 5, with a passage 6 for connection to an injector, not illustrated. The passage 6 is formed in a tubular connector 7 fixed to the body 1 of the pump and defining a cavity 8 for housing the delivery valve 5.

As illustrated in greater detail in FIG. 2, the delivery valve includes a tubular body 9 clamped axially between the cylinder 2 and the tubular connector 7 so as to communicate at one end with the pressure chamber 4 and at the other with the cavity 8. The tubular body 9 acts as a guide member for an elongate valve body, generally indicated 10, an intermediate zone of which forms an enlargement with a conical surface 11 constituting the obturator of the valve 5. The obturator 11 cooperates with an annular valve seat 12 formed at the end of the body 9 opposite the pressure chamber 4, and is urged into its closed position against this seat 12 by a helical compression spring 13 housed in the cavity 8 and reacting against the top thereof.

Beneath the obturator 11 the body 10 has a series of longitudinal millings 14 for the passage of the fuel and above the obturator 11 has a cavity forming an axial chamber 16 containing a calibrated one-way valve, generally indicated 17.

The chamber 16 is defined at the end with the obturator 11 by a bottom wall 18 spaced axially from the obturator 11 and is closed at the opposite end by a stopper 19 clamped in a predetermined axial position as a result of the deformation of the corresponding end of the body 10. As will be seen below, the stopper 19 could be connected to the body 10 by a threaded coupling or could be replaced by a transverse wall integral with the body 10.

An axial blind passage 20, which has calibrated dimensions in terms of its passage section, opens into the bottom wall 18 of the chamber 16 and communicates with radial passages 21 opening in their turn into the chamber 8 of the tubular connector 7, and a lateral axial passage 22. This lateral axial passage 22 is offset relative to the central axial passage 20 and the radial passages 21 and extends through the body 10 to terminate at one of the millings 14. Thus, this lateral axial passage 22 puts the chamber 16 into communication with the pressure chamber 4 of the pump.

The edge of the axial passage 20 in correspondence with the bottom wall 18 defines an annular valve seat 23 with which cooperates a ball obturator 24 carried by a support 25 against which reacts one end of a helical compression spring 26 whose other end bears against the stopper 19. The support 25 has a shape such as partially to surround the ball 24 through an angular extent greater than 180°, whereby, in practice, the obturator 24 is axially rigid with this support 25.

In operation, at the end of each cycle of opening of the delivery valve 5, the one-way valve 17 acts so as to damp any over-pressures in the fuel duct 6 to the injector, thus ensuring that the residual pressure at the end of the injection cycle is constant at predetermined values.

The two variants illustrated in FIGS. 3 and 4 are generally similar to the embodiment described above and only the differences will be described in detail, the same reference numerals being used for identical or similar parts.

In the case of FIG. 3, the body 10 is constituted by two parts: a lower part 28 carrying the conical-surface obturator 11 and an upper part 30' in the form of a cap thrust onto the lower part 28 during assembly. In this case, the spring 26 bears against the transverse bottom wall 19' of the cap 30' and its calibration is predetermined during assembly.

In the assembled condition, the spring 13 helps to ensure that the cap 30' is correctly positioned on the part 28.

In the case of FIG. 4, the body 10 is also formed in two parts, a lower part 28 and an upper part 30'', respectively, connected together by axial thrusting, and the second of these is closed at its top by a stopper 19'' which is connected to the part 30'' by a threaded coupling 29 and against which the spring 26 bears with the interposition of any spacers 27. This solution allows the adjustment of the calibration of the spring 26 and hence of the impact travel of the support 25 during opening of the ball obturator 24. The fixing of the stopper 19'' in its adjusted position may possibly be achieved by glue or any other means.

Naturally, the scope of the present invention extends to models which achieve equal utility by using the same innovative concept.

We claim:

1. A delivery valve for fuel injection pumps for diesel engines, of the type including a tubular valve body fixable to the pressure chamber outlet of an injection pump and defining an annular valve seat, a conical-surface obturator which cooperates with the annular valve seat, a biassing spring which urges the obturator into a closed position against the seat, a body to which the conical-surface obturator is fixed and which defines an axial chamber and fuel return passages communicating with the chamber and opening respectively upstream and downstream of the conical-surface obturator, and a calibrated one-way valve with a ball obturator and a biassing spring for the obturator, which is housed in said axial chamber and controls communication between the fuel return passages, wherein the chamber in said body has a bottom wall located at the end with the conical-surface obturator and spaced therefrom, the ball obturator of the one-way valve is located at the end of the chamber with the bottom wall, and wherein the return passages include at least one radial hole formed in the body between the conical-surface obturator and the bottom of the chamber, a central axial passage through which the radial hole communicates with the chamber and which forms a valve seat for the ball obturator, and a lateral axial passage which is offset relative to the central axial passage and the radial hole and puts the bottom of the chamber of said body into communication with the pressure chamber.

2. Valve according to claim 1, wherein the ball obturator is carried by a support against which reacts one end of the biassing spring the opposite end of which reacts against a closure part for the chamber.

3. Valve according to claim 2, wherein the closure part for the chamber is constituted by a closure stopper fixed to the body in an axial position which is variable in dependence on the calibration of the spring and the opening travel of the ball obturator.

4. Valve according to claim 2, wherein the closure part for the chamber is constituted by a transverse wall integral with the body.

* * * * *